United States Patent [19]

Werring et al.

[11] Patent Number: 4,849,673

[45] Date of Patent: Jul. 18, 1989

[54] ELECTROLUMINESCENT DEVICES WITHOUT PARTICLE CONDUCTIVE COATING

[75] Inventors: Norman J. Werring, Poole; Ray Ellis, Wimborne; Malcolm H. Higton, Poole, all of England

[73] Assignee: Phosphor Products Company Limited, Poole, England

[21] Appl. No.: 219,824

[22] Filed: Jul. 15, 1988

Related U.S. Application Data

[63] Continuation of Ser. No. 900,382, Aug. 26, 1986, abandoned.

[30] Foreign Application Priority Data

Sep. 6, 1985 [GB] United Kingdom ..... 8522143

[51] Int. Cl.[4] ..... H05B 33/20; H05B 33/22

[52] U.S. Cl. ..... 313/506; 313/498

[58] Field of Search ..... 313/498, 503, 506, 509, 313/512, 511

[56] References Cited

U.S. PATENT DOCUMENTS

| | | | |
|---|---|---|---|
| 4,137,481 | 1/1979 | Hilsum et al. | 313/512 X |
| 4,315,190 | 2/1982 | Peters et al. | 313/467 |
| 4,652,794 | 3/1987 | Waite et al. | 313/506 X |

FOREIGN PATENT DOCUMENTS 2135117 8/1984 United Kingdom .

*Primary Examiner*—Kenneth Wieder

*Attorney, Agent, or Firm*—Kerkam, Stowell, Kondracki & Clarke

[57] ABSTRACT

The present invention concerns an electroluminescent panel suitable for unidirectional and/alternating voltage order, a transparent glass substrate (10), a thin transparent front electrode film (12) made of indium-tin-oxide, a first thin (preferably 1-2 microns thick) layer (14) of a phosphor in the form of powder particles, the surface of the particles being free of any metallic coating, e.g. Cu coating, an electrically conducting, dark powder layer (16) which is a control layer consisting e.g. of $MnO_2$ uncoated or undoped with Cu and a (preferably aluminium) back electrode layer )18).

13 Claims, 6 Drawing Sheets

Figure 1:
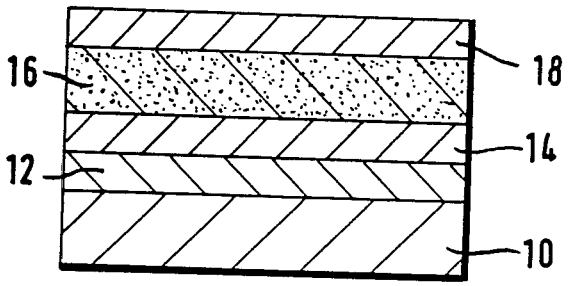

$10^3$
$10^2$
$10^1$
$10^0$
$10^{-1}$
B (fL)
0 10 20 30 40 50 60 70 80 90 100 110 120 130 140 150 160 170 180
(V)

ELECTROLUMINESCENT DEVICES WITHOUT PARTICLE CONDUCTIVE COATING

This is a Continuation of Application Ser. No. 900,382, filed Aug. 26, 1986, abandoned.

This invention relates to electroluminescent (EL) devices, such as phosphor panels and displays designed for both unidirectional and alternating voltage operation, such devices being abbreviated as DCEL or ACEL devices.

Thick film powder DCEL panels, which are also capable of ACEL operation, are conventionally manufactured by a process comprising the steps of:

(a) depositing a transparent front electrode film e.g. of tin oxide, onto a transparent insulating substrate, e.g. glass;

(b) spreading an active layer, comprising phosphor particles, such as Zinc Sulphide (ZnS) doped with an activator such as Manganese (Mn) and coated with copper suspended in a binder medium, on the front electrode; this layer is typically 10–50 μm thick (hence 'thick film' device);

(c) depositing a back electrode film, e.g. of aluminium on the active layer;

(d) applying a unidirectional voltage to the electrode films for a predetermined time, so that in the region of the positively biased front electrode the copper coating is stripped from phosphor particles to form a high resistivity, high light output layer, typically 1–2 μm thick. The relatively thick layer of unstripped phosphor particles then remaining behind this thin light-emitting layer constitutes a highly conductive control layer.

The last step, (d) in the manufacturing process, is known as 'forming' and is more particularly described in GB- A-1,300,548. The electrodes can of course be laid down in any desired shape to produce a particular display, e.g. if the electrodes comprise mutually perpendicular strips 9 matrix of active phosphor elements, or 'dots' will be defined each of which may be addressed and driven using conventional electronic techniques to form alpha-numeric characters. Having such a process the applicants have designed and built a 2000-character DCEL panel suitable for use with a computer as a monitor display and replacing the conventional bulky cathode ray tube monitor display.

The powder panels described above are self-protecting in that the copper-coated powder backlayer, known as the control layer, protects the thin, high resistance, light-emitting 'formed' layer from catastrophic breakdown due to excessive current density at defects or points of weakness by further copper stripping or forming at such 'hot spots'.

The above-described manufacturing process involves a number of disadvantages.

Firstly, step (b) requires the ZnS:Mn phosphor particles to be coated with Cu. This requires a separate procedure which is time-consuming, relatively expensive and difficult to control. Secondly, the 'forming' step, step (d), is also expensive, takes an appreciable length of time and introduces problems of reproducibility.

Thirdly, the finished products can sometimes exhibit longterm brightness degradation, due largely (it is believed) to a phenomenon known as 'further forming' in which the region of high resistivity produced by the initial 'forming' gets thicker because of further Cu migration, effectively reducing the field at constant voltage over the formed region. To ensure a more reproducible manufacturing technique, not requiring the expensive and time-consuming 'forming' operation, a composite thin film (TF) powder electroluminescent panel has been proposed (see 'A Composite ZnS Thin Film Powder Electroluminescent Panel', C. J. Alder et al, Displays, January 1980, at page 191). Such panels are in effect hybrid structures in which a thin film, equivalent to the light-emitting 'formed' layer in conventional DCEL panels, is coated with the copper-coated phosphor backlayer, i.e. control layer. The thin film is of semi-insulating activator-doped phosphor, such as ZnS doped with Mn, and is typically 200 A to 1 μm thick. This light-emitting film is deposited onto the transparent front electrode of the panel by sputtering, evaporation, electrophoretic plating or any of the known ways of depositing thin films on substrates. The conventional copper-coated phosphor control layer and the back electrode are spread and vacuum-deposited onto the light-emitting film in the known manner. The control layer need not contain Mn since the light emitted by the device originates from the thin film.

U.S. Pat. No. 4,137,481 describes such a hybrid panel which may or may not require the application of a forming current before it is ready for use. If a forming current is required, forming is found to occur at much lower current densities than those required for conventional thick film DCEL panels.

However, in this U.S. patent, the control layer is a phosphor material, whereas in this invention the control layer is not a phosphor. In the U.S. patent, the control layer is made up of grains of Mn-doped ZnS coated with Cu, which involves the same problems and extra costs as discussed above in connection with step (b). It is the Cu coating which makes the control layer of this U.S. patent conductive; in contrast, the preferred control layer in this invention is manganese dioxide powder, although it can also contain other manganese oxides; manganese dioxide is not a phosphor, is inherently conductive, contains no luminescent dopant or activator, does not require metallic coating and is dark/black. Its resistivity can vary widely but is normally of the order of $10^6$ to $10^4$ ohm-cm and its band gap is of the order of 1 eV.

The hybrid DCEL panel is protected by the control layer from catastrophic breakdown due to excessive current density at defects and points of weakness by retaining its 'forming' properties in the same way as the 'thick film powder only' DCEL panels. However, the known hybrid panels using conventional copper-coated phosphor control layers still suffer from the effects of 'further forming' during extensive use leading to brightness degradation with time. Again, the contrast provided by such known hybrid devices is poor.

Still further, DCEL devices, whether all-TF or hybrid TF-and-powder, require a costly vacuum deposition process for applying the TF emitting layer to the transparent front electrode, usually tin oxide or indium-tin-oxide (ITO). Also, certain TF devices suffer from a defect known as 'pinhole burn-out' in which the life of the device falls appreciably below anticipated values due to imperfections in the TF structure.

It is an object of the present invention to reduce the drawbacks of known ACEL or DCEL devices and provide an all-powder composite DCEL or ACEL panel with improved brightness maintenance during its operational lifetime, improved reproducibility and improved contrast enhancement at reduced manufacturing and investment costs.

According to the present invention, an electroluminescent panel suitable for unidirectional and/or alternating voltage operation includes, in serial order, a transparent electrically insulating substrate, a thin transparent first (front) electrode film, a first thin layer of a phosphor in the form of powder particles the surface of which are free of any conducting coating, e.g. Cu coating, and an electrically conducting layer which is a control layer.

Preferably, the control layer functions also as a second electrode. In an alternative preferred embodiment, the control layer is covered by second electrode or plurality of second electrodes.

The word 'thin' is used herein, when describing the first phosphor layer, as describing a thickness an order of magnitude smaller than that of thick films; typically, less than 10 microns, preferably 0.5 to 5 microns, most preferably 1 to 2 microns.

The material of the first layer may be chosen in accordance with the required colour of the emission. Thus, for yellow/orange ZnS:Mn is preferred, but CaS:Ce green, SrS:Ce blue and CaS:Eu red phosphors may be used, amongst others.

The control layer is preferably dark or black for contrast enhancement, and one of the most preferred materials is manganese dioxide. The first layer is preferably applied by a deposition technique, e.g. electrophoresis, dipping, spraying or settling of powders. The powder particles in this layer have no conducting surface coating, as already mentioned, but may include Cu-containing phosphors which are essentially insulating, i.e. containing Cu as a dopant, or surface defect inclusions. The control layer may advantageously be deposited by a settling, spreading or spraying technique, or any other known and suitable method of depositing thin powder layers.

In a preferred embodiment, there may be a so-called interlayer provided between the first or front layer and the control layer to enhance contrast and/or stability. The interlayer is preferably a thin powder layer with a thickness comparable to or less than that of the first layer, preferably less than 0.1 microns. It may also be a thin film interlayer, and advantageously of dark colour, for example, ZnTe (dark brown), CdTe (black), CdSe (black/brown), a Chalcogenide glass (black), or $Sb_2S_3$ (black/brown), or any other suitable dark material. The use of a dark-coloured interlayer has the advantage of allowing the use of control layers which are not dark coloured; conversely, the interlayer may be transparent when the control layer is dark coloured.

The accompanying schematic drawing illustrates a preferred embodiment of a DCEL device according to the invention in schematic cross-section.

In the drawing, the device 20 is seen to consist, in serial order, of a glass substrate 10, a front electrode 12 made of ITO, a thin front powdered phosphor layer 14 of a thickness of typically 1-2 microns and made of uncoated ZnS:Mn, a black powder control layer 16 of $MnO_2$ which is conductive, and an aluminium rear electrode layer 18.

Preferred embodiments of the invention will now be described with the aid of Examples.

EXAMPLE 1

ZnS:Mn powder layers were electrophoretically deposited onto 4-dot (approx. 0.04 $cm^2$/area) ITO substrates.

The best layers appeared almost transparent to the eye. When the particles were observed using reflected light under the optical microscope they appeared in greater density at the electrode edges for some samples. This was confirmed by scanning electron microscope examination: little or no ZnS powder was observed at the centre of the electrodes for some samples.

Although $MnO_2$ powder was used to fabricate the majority of test panels, some layers were initially tested with backlayers of undoped, copper-coated ZnS, using conventional spreading. Yellow DCEL emission was observed under continuous DC testing at voltages as low as 5–10 V, after a 'forming' process. Subsequently, the emission was concentrated at the electrode edge. By 'flash forming' (i.e. applying an initial voltage of 10–15 V directly onto the area), a much more uniform emission could be observed over the whole dot. Up to 12 fL was observed at 70 V continuous DC from these uniform areas, at $<1$ mA/area (approx. 0.002 % power efficiency). Under pulsed DC at 10 $\mu$s pulses 1% duty cycle these 'formed' areas could exhibit 14 fL at 160 V.

Test panels with spread $MnO_2$/binder layers also exhibited a drop in current under initial continuous DC testing prior to pulsed assessment. This effect however, seems to be due to destructive pinholing dielectric breakdown or burn-out of area at the electrode centre. Electrode edge emission was observed in most cases, although by using the above technique which was found to induce a more uniform emission for Cu-coated backlayers, large enough portions of the dot for brightness measurements could be created.

Figure 2:
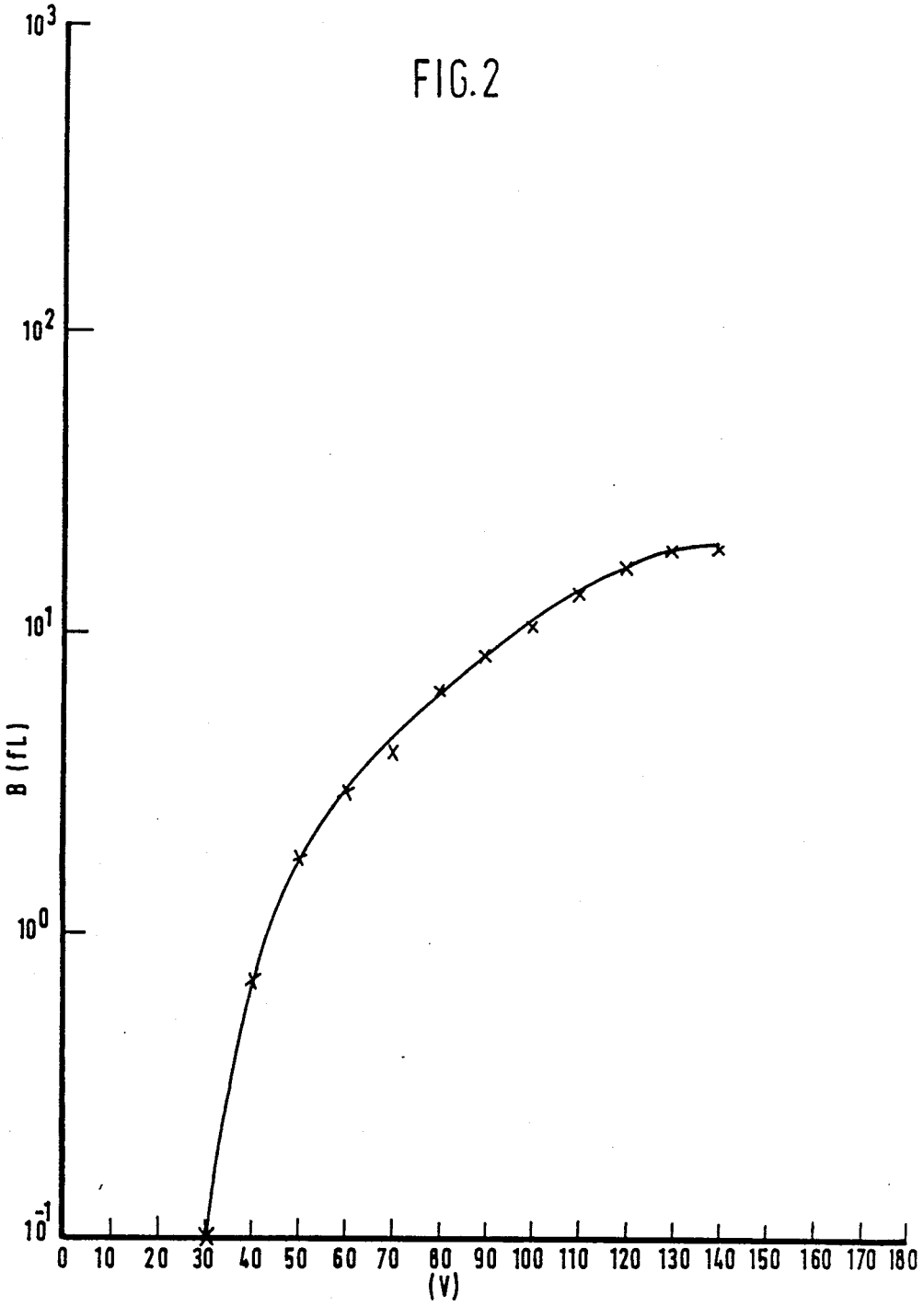

Under both pulsed and continuous DC, emission was observed at voltages as low as 20–30 V. Up to 24 fL at 60 V continuous DC and 19 fL under pulsed DC at 140 V, 10 $\mu$s pulses 1% duty cycle was observed (FIG. 2), with similar efficiencies for the Cu/ZnS backlayer taking into account the % area emitting.

In addition, a more uniform full pixel emission was obtained by reducing the size of the emitting area, for instance to that obtained by using a resolution of 80 lines/inch. In this case the ITO track is apparently thin enough to act as an 'edge' itself attracting a more dense and uniform deposition.

EXAMPLE 2

To achieve deposition of a thin zinc sulphide/manganese phosphor layer by settling, a homogeneous suspension of fine particles in a dilute nitrocellulose, binder, e.g. one commercially available under the Trade Mark Belco from I.C.I Ltd., was prepared. Layers on 10 bar ITO substrates having emitting areas of approximately 0.18 $cm^2$ were initially prepared by placing the substrate in a beaker and covering with the suspension to a depth of approximately 2 cm. After a given time, the suspension was syphoned off, and the layer formed on the substrate allowed to air dry. Panels were fabricated from these layers with spread control layers of manganese dioxide in a nitrocellulose binder.

Figure 3:
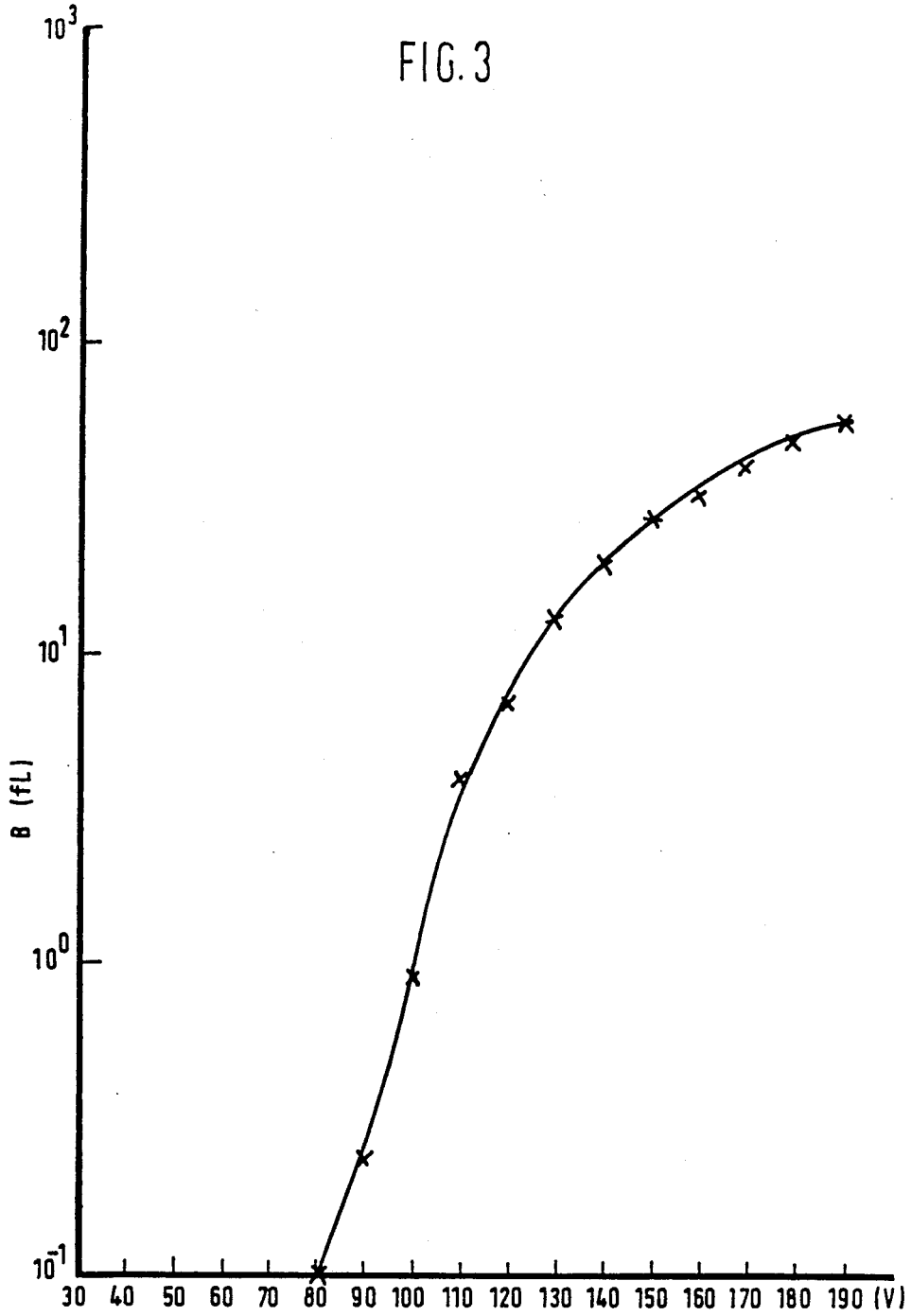

With a given binder concentration in the suspension and a settling time to 2–10 minutes thin layers were obtained which yielded visible emission at 80–100 V DC and approximately 30 fL at 150 V and 55fL at 190 V, under 10 $\mu$s, 1% duty cycle excitation (SL2/5) (FIG. 3). Efficiencies of approx. 0.06% at the lower voltages and approx. 0.01% at the higher voltages were observed.

EXAMPLE 3

In order to reduce the voltage, the binder concentration was reduced until the layers were clearly predominantly phosphor with just sufficient binder to ensure adhesion.

Employing settling times of 2–5 minutes gave thin uniform layers formed by drying of the suspension remaining on the substrate, rather than settled phosphor particles. The procedure of Example 2 was therefore modified to pipetting a known volume of suspension on a level substrate and allowing it to dry.

The uniformity of these layers was comparable with that achieved by settling. Panels with $MnO_2$ backlayers yielded 5–10 fL at 35 V DC and up to 27 fL at 90 V, 10 μs, 1% duty cycle.

The 10-bar panels containing the various settled layers described above exhibited DCEL emission without the usual 'forming' process, or initial high currents found for the electrophoretic layers, Under initial continuous DC tests or during electrical characterization, however, a fall in current was observable with time.

For the various settling techniques, a varying degree of emission uniformity was observed. Factors affecting uniformity appear to be debris (resulting in non-emitting dots), non-uniform drying (resulting in, for example, localised thickness variation, hence varying voltage requirements), pin holes etc. The powder density of the settled layers may, however, be controlled much more effectively at present than for the electrophoretic layers described in Example 1, thus emission is not restricted to the edges of larger 10 bar areas. Drying of a flat substrate in a horizontal position without any air turbulence is preferred at present for adequate uniformity of the thickness and brightness.

Figure 4:
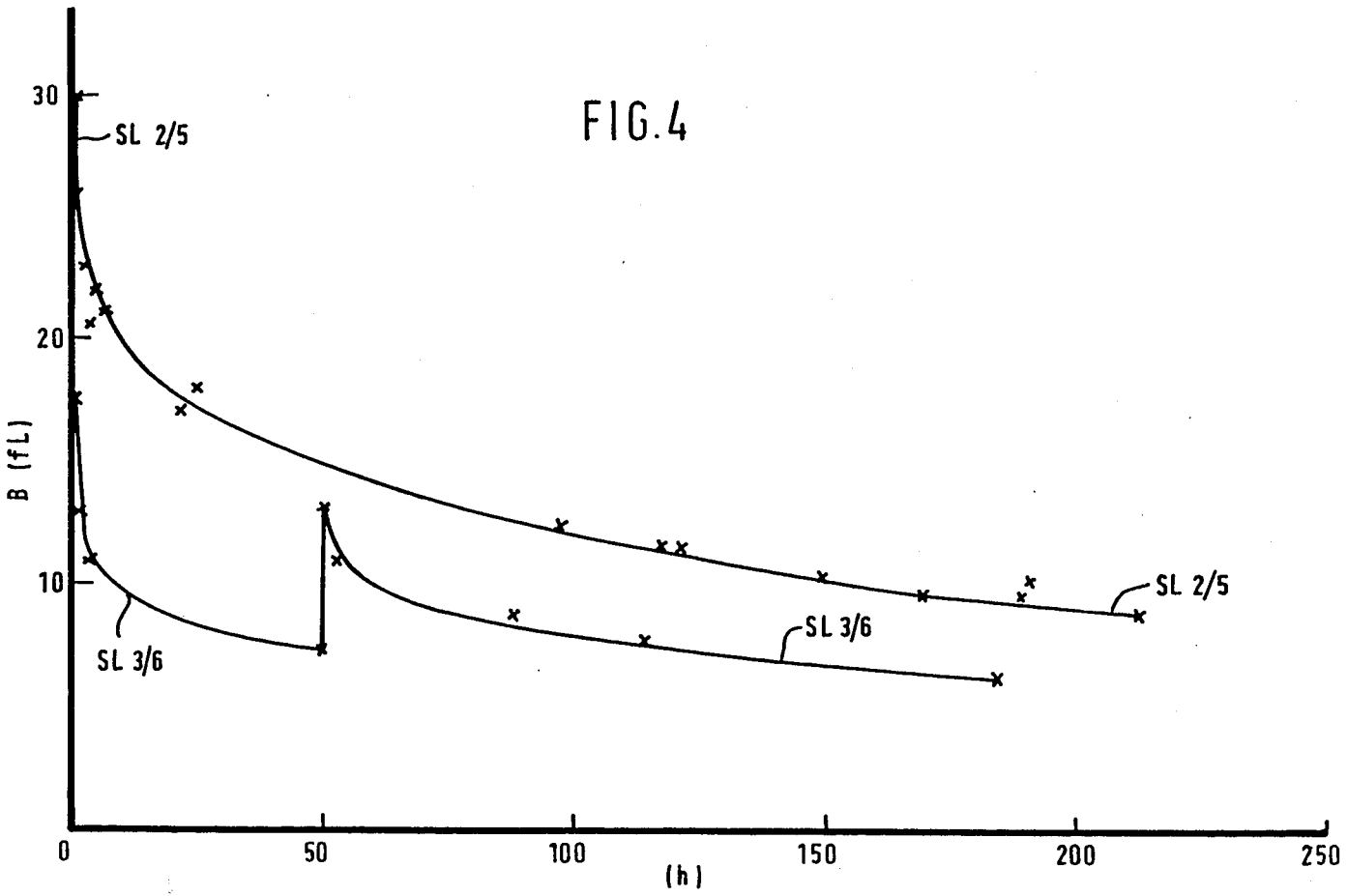
Figure 5:
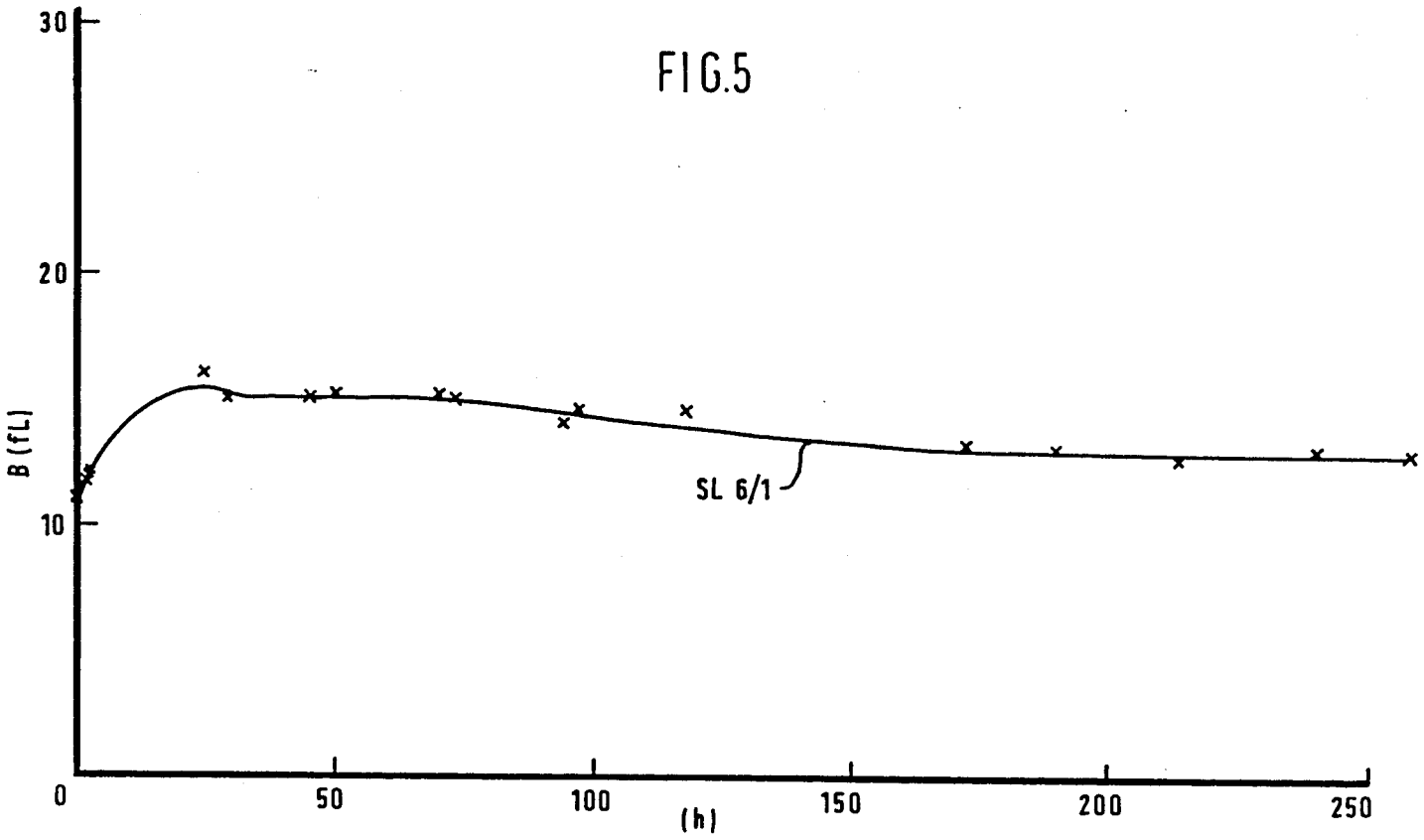

The life test curves of brightness B in fL against life in hours, h (FIGS. 4, 5, 6) show variation in performance. The specimens designated by SL2/5 and SL3/6 (1:5 binder) drop in brightness and current as for conventional devices (FIG. 4). SL2/5 was operated at 170 V at an efficiency approaching 0.02% while specimen SL3/6 was started at 130 V which was increased to 135 V after 50 hours and operated at an efficiency approaching 0.03%.

Figure 6:
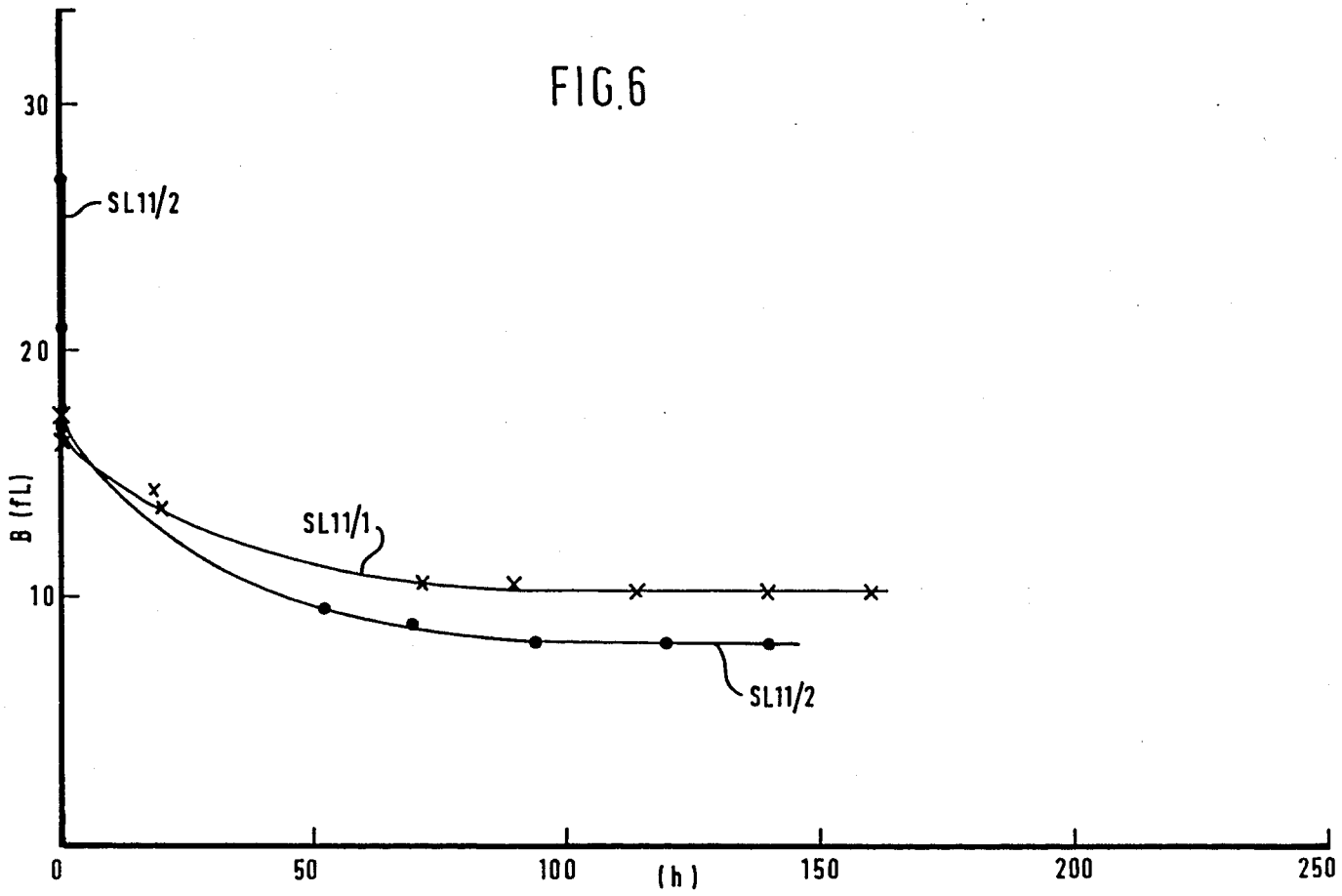

The specimen designated by SL6 (1:10 binder) was operated at 150 V at an efficiency of less than 0.02 %. It consisted of a control layer of dry $MnO_2$ and acts more like the TF-powder hybrid with a flatter response i.e. it continues at 11 FL for at least 5000 hours. The specimens designated by SL11 (1:100 binder) were intermediate the SL2 and SL6 specimens (FIG. 6). Specimen SL11/1 was operated at 75.1 V, efficiency less than 0.004%, while specimen SL11/2 was operated at 90.1 V, efficiency less than 0.01%. It is assumed that the binder concentration may contribute to the brightness degradation with the thinner SL11 layers (i.e. lower V operation) possibly suffering from ingress of binder from the applied control layer.

The above Examples illustrate that the all-powder DCEL devices embodied in the invention exhibit advantages as follows:

1. No Cu-coating, forming, and potentially no long life treatment requirements.
2. Improved brightness stability and potentially increased temperature range.
3. Improved contrast enhancement.
4. Possibility of using low voltage drives.
5. Ability to use different coloured phosphors.

In addition to improved performance, the advantages for large scale production are clear, i.e. the obviation of several expensive processes such as forming etc. The use of a simple layer deposition technique such as electrophoresis, dipping, or settling of powders, (which have large scale potential), are also an advantage over the known TF systems which require costly vacuum deposition of the emitting layer.

We claim:

1. An electroluminescent device suitable for unidirectional or alternating voltage operation including, in serial order, a transparent electrically insulating substrate, a thin transparent first (front) electrode film, a first layer of a phosphor and an electrically conducting layer which is a control layer, the improvement consisting in that said first layer consists of powder particles, the surface of the particles being free of any metallic coating, and in that said control layer is a naturally dark powder layer the material of which is inherently conductive and the band gap of the material of the control layer is not greater than about 1 eV.

2. An electroluminescent device suitable for unidirectional or alternating voltage operation including, in serial order, a transparent electrically insulating substrate, a thin transparent first (front) electrode film, a first layer of a phosphor and an electrically conducting layer which is a control layer, the improvement consisting in that said first layer consists of powder particles, the surface of the particles being free of any conducting coating, and in that said control layer is a naturally dark powder layer the material of which is not, or does not include, a phosphor and the band gap of and the material of the control layer is not greater than about 1 eV.

3. A device according to claim 1, wherein the control layer is not, or does not include, a phosphor.

4. A device according to claim 1, wherein the control layer consists of manganese dioxide powder particles, the surface of the particles being free of Cu coating.

5. A device according to claim 2, wherein the control layer consists of manganese dioxide powder particles, the surface of the particles being free of Cu coating.

6. A device according to claim 1, wherein there is an interlayer provided between the phosphor layer and the control layer to enhance contrast and/or stability, said interlayer being either (a) a thin powder layer with a thickness comparable to or less than that of the phosphor layer, preferably less than 0.1 microns; or (b) a thin film interlayer.

7. A device according to claim 2, wherein there is an interlayer provided between the phosphor layer and the control layer to enhance contrast and/or stability, said interlayer being either (a) a thin powder layer with a thickness comparable to or less than that of the phosphor layer, preferably less than 0.1 microns; or (b) a thin film interlayer.

8. An electroluminescent device suitable for unidirectional or alternating voltage operation including, in serial order, a transparent electrically insulating substrate, a thin transparent first (front) electrode film, a first layer of a phosphor and an electrically conducting layer which is a control layer, the improvement consisting in that said first layer consists of powder particles, the surface of the particles being free of any conducting coating, and in that said control layer is a dark powder layer the material of which is a non-phosphor material having a band gap not exceeding substantially 1 eV and being free of any metallic inclusions and phosphors, the particles of said material being free of any metallic coatings.

9. An electroluminescent device suitable for undirectional voltage operation including, in serial order, a transparent electrically insulating substrate, a thin transparent first electrode film, a first layer of a phosphor and an electrically conducting layer which is a control layer, the improvement consisting in that:

said first layer consists of powder particles, said control layer is a powder layer the material of which is not, and does not include, a phosphor, the surfaces of the powder particles in both of said layers being free of any conducting coating, and the material of said control layer is (i) inherently dark, and (ii) inherently electrically conducting.

10. A device according to claim 9, wherein the band gap of the material of the control layer is about 1 eV or less.

11. A device according to claim 9, wherein the control layer consists of manganese dioxide powder particles, the surface of the particles being free of any metallic coating.

12. A device according to claim 9, wherein the control layer consists of manganese dioxide powder particles, the surface of the particles being free of any Cu coating.

13. An electroluminescent device according to claim 9, where the materials of said control layer is a non-phosphor material having a band gap not exceeding substantially 1 eV and being free of any metallic inclusions and phosphors, the surfaces of the particles of said powder material being free of any metallic coatings.

* * * * *